US008783742B2

(12) United States Patent
Puscas et al.

(10) Patent No.: US 8,783,742 B2
(45) Date of Patent: Jul. 22, 2014

(54) DUAL-MEMBER INERTIA-ACTIVATED LOCKING MECHANISM FOR VEHICLE DOOR HANDLE ASSEMBLY

(75) Inventors: Livianu Dorin Puscas, Rochester Hills, MI (US); Karl Lambertz, Troy, MI (US); Vlad Negrut, Windsor, CA (US)

(73) Assignee: Kiekert Aktiengesellschaft, Heiligenhaus (DE)

( * ) Notice: Subject to any disclaimer, the term of this patent is extended or adjusted under 35 U.S.C. 154(b) by 444 days.

(21) Appl. No.: 12/397,531

(22) Filed: Mar. 4, 2009

(65) Prior Publication Data

US 2009/0223263 A1 Sep. 10, 2009

Related U.S. Application Data

(60) Provisional application No. 61/033,732, filed on Mar. 4, 2008, provisional application No. 61/038,408, filed on Mar. 20, 2008.

(51) Int. Cl.
*E05B 3/00* (2006.01)

(52) U.S. Cl.
USPC ..... 292/336.3; 292/DIG. 22

(58) Field of Classification Search
USPC ..... 292/336.3, 344
See application file for complete search history.

(56) References Cited

U.S. PATENT DOCUMENTS

| | | | | |
|---|---|---|---|---|
| 3,799,596 | A * | 3/1974 | Nozomu et al. | 292/216 |
| 6,712,409 | B2 * | 3/2004 | Monig | 292/336.3 |
| 6,971,688 | B2 * | 12/2005 | Drysdale et al. | 292/216 |
| 7,070,216 | B2 * | 7/2006 | von zur Muehlen | 292/336.3 |
| 7,111,880 | B2 * | 9/2006 | Saitoh | 292/336.3 |
| 7,163,240 | B2 * | 1/2007 | Odahara | 292/347 |
| 7,198,307 | B2 * | 4/2007 | Drysdale et al. | 292/216 |
| 7,201,405 | B2 * | 4/2007 | Le et al. | 292/93 |
| 7,210,716 | B2 * | 5/2007 | Mueller et al. | 292/336.3 |
| 7,303,217 | B2 * | 12/2007 | Savant | 292/336.3 |
| 7,635,151 | B2 * | 12/2009 | Rodawold et al. | 292/336.3 |

FOREIGN PATENT DOCUMENTS

| | | | |
|---|---|---|---|
| DE | 199 01 279 | A1 | 7/2000 |
| EP | 1 593 801 | A1 | 11/2005 |
| WO | 2004-042177 | A1 | 5/2004 |
| WO | 2008/068259 | A1 | 6/2008 |

* cited by examiner

*Primary Examiner* — Mark Williams
(74) *Attorney, Agent, or Firm* — Renner, Otto, Boisselle & Sklar, LLP

(57) ABSTRACT

A dual-member locking mechanism for a vehicle door handle assembly activated by an inertial force acting on the locking mechanism, comprising a first lever having a first axis of rotation; and a second lever having a second axis of rotation; wherein the first lever is engageable with the door handle assembly; the second lever comprises a weight member and a finger member; the finger member is engageable with the first lever; and the second lever is rotatable around the second axis of rotation in response to the inertial force.

17 Claims, 4 Drawing Sheets

DUAL-MEMBER INERTIA-ACTIVATED LOCKING MECHANISM FOR VEHICLE DOOR HANDLE ASSEMBLY

CROSS-REFERENCE TO RELATED APPLICATIONS

This application claims priority to Provisional Application No. 61/033,732 filed on Mar. 4, 2008 and to Provisional Application No. 61/038,408 filed on Mar. 20, 2008, the contents of both of which are incorporated herein by reference in their entirety.

BACKGROUND OF THE INVENTION

1. Field of the Invention

This invention relates to a motor vehicle door handle assembly and more particularly to a locking mechanism for a motor vehicle door handle assembly which is activated by inertial forces.

2. Description of the Related Art

Typically, motor vehicles include door handles for opening doors. A door handle may include a frame and a grip. When the grip is actuated relative to the frame of the handle, the door latch mechanism is released, and the door is opened.

It is well-known that during motor vehicle collisions, parts of the door handle or other vehicle components may accelerate and cause unwanted actuation of the grip resulting in opening of doors. This is an undesired effect as it often leads to ejection of occupants and to greater injuries.

In order to prevent vehicle doors from opening during collision, various types of mechanisms have been employed. Specifically, known are mechanisms which temporarily disengage a handle from a door latch or temporarily block the transfer of forces from a door handle to a door latch during collision.

For example, from U.S. Pat. No. 6,712,409, known is a mechanism that includes an electrical crash sensor and a viscosity-framed crash locking unit. When the crash sensor senses collision, it electrically increases the viscosity of the medium within the crash locking unit blocking the transfer of forces from the door handle to the door latch. After collision, the viscosity of the medium is lowered, and the handle is reconnected to the door latch.

From U.S. Pat. No. 7,201,405, known is also a mechanism that includes a mechanical locking tab, a weight attached to a cable, and a spring. When a crash force is applied, the weight moves and causes displacement of the locking tab preventing a latch mechanism from releasing and opening the vehicle door. When the crash force is removed, the spring returns the locking tab to its original position, allowing for a transfer of forces between the handle and latch mechanism.

The state of the art is not fully satisfactory, however, as conventional mechanisms engage too slowly and disengage too quickly in a collision. The invention aims to remedy this situation.

The invention is framed on the technical problem of improving a motor vehicle door handle assembly in such a way that a door release system is reliably engaged as soon as possible after an collision and reliably disengaged only after collision forces have subsided.

SUMMARY OF THE INVENTION

In view of the above-described problems, the invention provides in one aspect a locking mechanism for a vehicle door handle assembly, which is activated by inertial forces acting on a vehicle during a collision and provides a reliable protection to occupants of the vehicle by blocking doors from opening during the collision.

To achieve the above objective, in accordance with one embodiment of the invention, provided is a two-member locking mechanism for a vehicle door handle assembly, comprising a first lever having a first axis of rotation; and a second lever having a second axis of rotation.

In one class of this embodiment, the first lever is engageable with the door handle assembly.

In another class of this embodiment, the second lever comprises a weight member and a finger member.

In another class of this embodiment, the finger member is engageable with the first lever.

In another class of this embodiment, within a certain angle of rotation, the first lever is rotatable around the first axis of rotation independently of the second lever, and the second lever is rotatable around the second axis of rotation independently of the first lever.

In another class of this embodiment, within a certain angle of rotation, the first lever is not rotatable around the first axis of rotation independently of the second lever, and the second lever is not rotatable around the second axis of rotation independently of the first lever.

In another class of this embodiment, the first axis of rotation and the second axis of rotation are one and the same axis.

In another class of this embodiment, the first lever and the second lever are spring-loaded.

In another class of this embodiment, the locking mechanism further comprises means for providing resistance to rotation of the first lever and the second lever.

In a subclass of this class, when the inertial forces acting on the locking mechanism are greater than forces exerted by the means for providing resistance to rotation, the first lever engages with the door handle assembly.

In another subclass of this class, when an inertial force is applied to the locking mechanism in a first direction, the first lever and the second lever rotate in concert whereby the first lever engages with the door handle assembly, and when an inertial force is applied to the locking mechanism in a second direction, the second lever rotates back to its original position and the first member continues to be engaged with the door handle assembly.

In another subclass of this class, the means for providing resistance to rotation is a helical spring.

In another class of this embodiment, the first lever further comprises a protrusion, the finger member being engageable with the protrusion.

In another class of this embodiment, the first lever and the second lever are secured around the first and the second axis of rotation, respectively, by a pivot bearing.

In another class of this embodiment, the locking mechanism is attached to the vehicle door handle assembly.

In yet another class of this embodiment, the mass of the weight member is greater than the mass of the finger member, and the mass of the weight member is also greater than the mass of the first lever.

BRIEF DESCRIPTION OF THE DRAWINGS

The invention is described hereinafter with reference to accompanying drawings, in which.

DETAILED DESCRIPTION OF THE INVENTION

Figure 1:
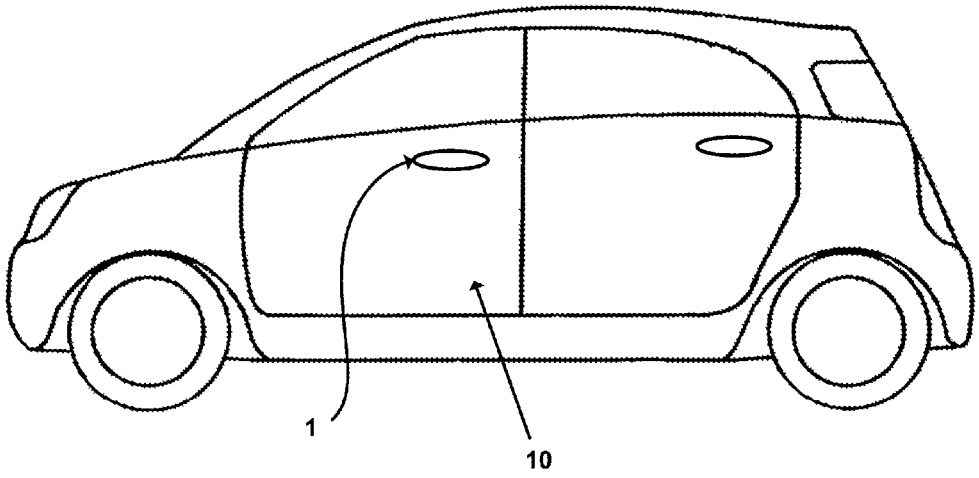
FIG. 1 is a schematic side view of a vehicle door showing the position of the vehicle door handle assemblies in accordance with an exemplary embodiment of the invention.

As shown in FIG. 1, a handle assembly 1 is mounted along a door 10 of a motor vehicle. The handle assembly 1 is operatively connected to a door release mechanism (not shown). When the door release mechanism is unlocked, the handle assembly 1 may be actuated by a user to unlatch the door release mechanism and open the door 10.

Figure 2:
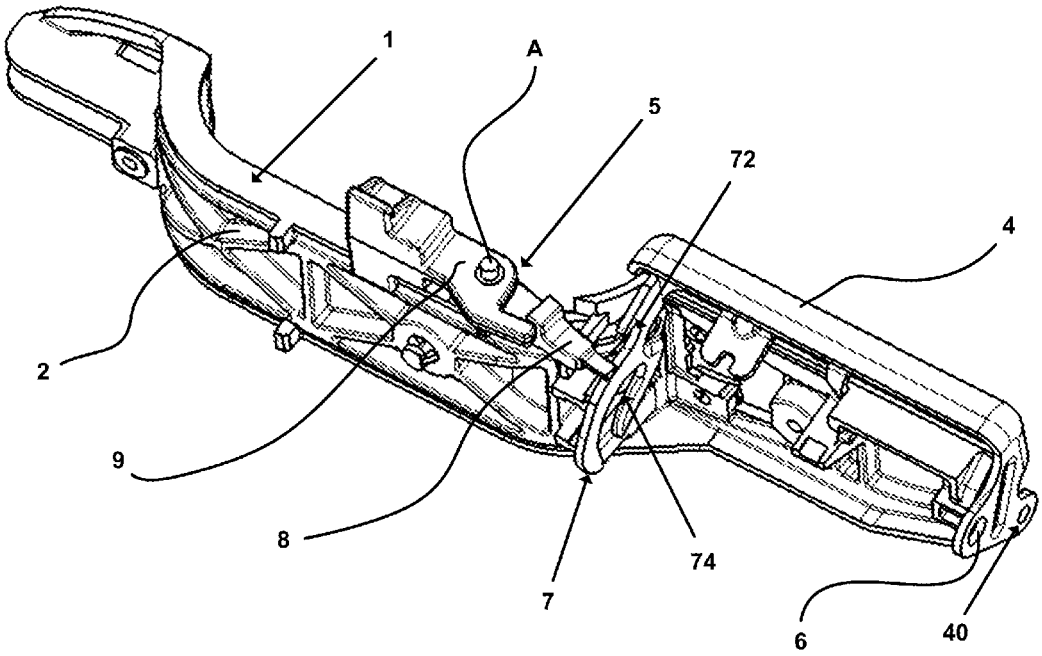
FIG. 2 is a perspective view of a vehicle door handle assembly including a locking mechanism in an unlocked position in accordance with an exemplary embodiment of the invention.
Figure 3:
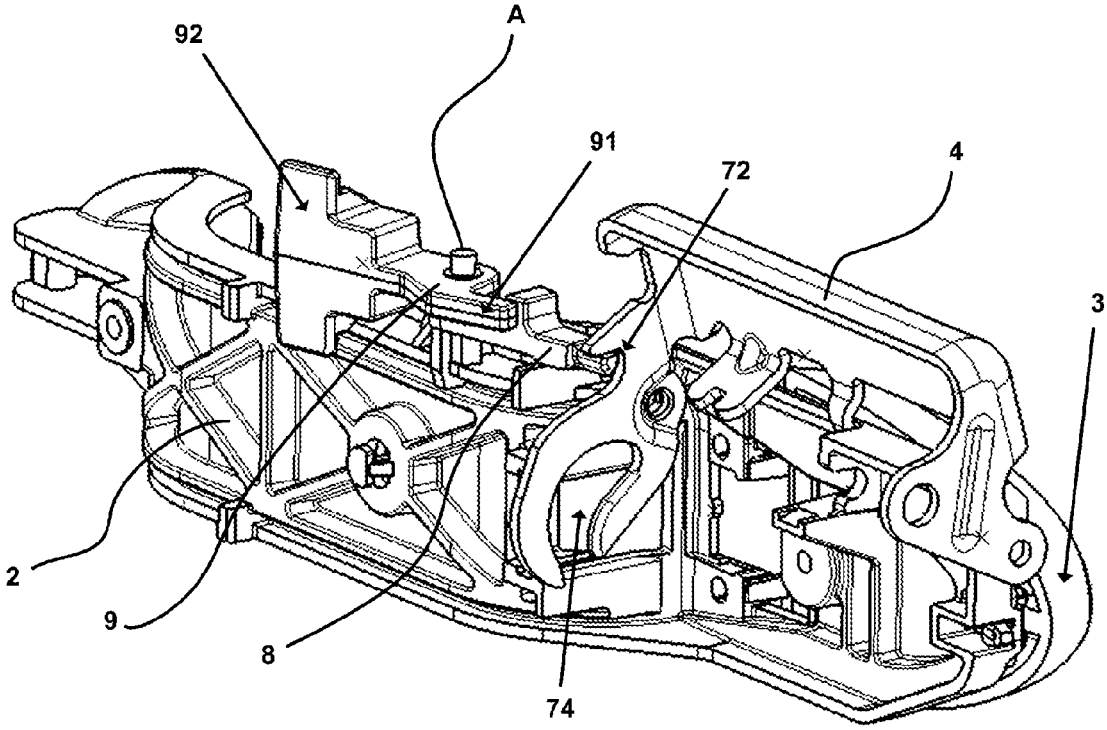
FIG. 3 is another perspective view of a vehicle door handle assembly including a locking mechanism in a locked position in accordance with an exemplary embodiment of the invention.

With reference to FIGS. 2-3, the handle assembly 1 includes a frame 2 adapted to be fixedly secured to the door 10 of the motor vehicle. A handle portion 3 (only partially shown) is pivotally coupled to the frame 2. The handle portion 3 is manually grasped by a user and pivoted relative to the frame 2 in order to actuate the handle assembly 1 and open the door.

The handle assembly 1 includes a counterweight 4 pivotally coupled to the frame 2 on the pivot axis 40. The counterweight 4 is at one of its ends connected via the connecting hole 6 and a rod (not shown) to the door release mechanism. The counterweight 4 is so set that up-and-down and side-to-side movements of a vehicle provided with the door 10 will not cause the handle 3 to move and with its movement to pivot the counterweight 4 and engage the door release mechanism. The counterweight 4 has at its other end a claw 7 for limiting the pivot angle of the counterweight 4. The claw 7 defines a first U-shaped opening 72 and a second U-shaped opening 74.

As shown in FIGS. 2-3, an inertia-activated locking mechanism 5 for use with the vehicle door handle assembly 1 is attached to the upper portion of the frame 2. A lever 8 is set on an axis A which at one of its ends is connected to the frame 2. On top of the lever 8 rests lever 9. Both levers are rotatable around the axis A via pivot bearings 11. The lever 9 includes a finger 91 and a weight member 92. The weight member 92 is disposed on the opposite side of the lever 9 with respect to the finger 91. The weight member 92 is the heaviest part of the lever 9. A bolt member 81 and a protrusion 82 are disposed on the lever 8.

A first helical spring 12 is set on the axis A between the frame 2 and the lever 8. A spacer 14 is disposed between the lever 8 and the lever 9 for spacing the levers apart and preventing damage to the levers during their relative motion. A second helical spring 13 may be disposed on the axis A between the lever 8 and lever 9. The springs 12, 13 provides resistance to rotation of the levers 8, 9 in both directions of motion.

Figure 4:
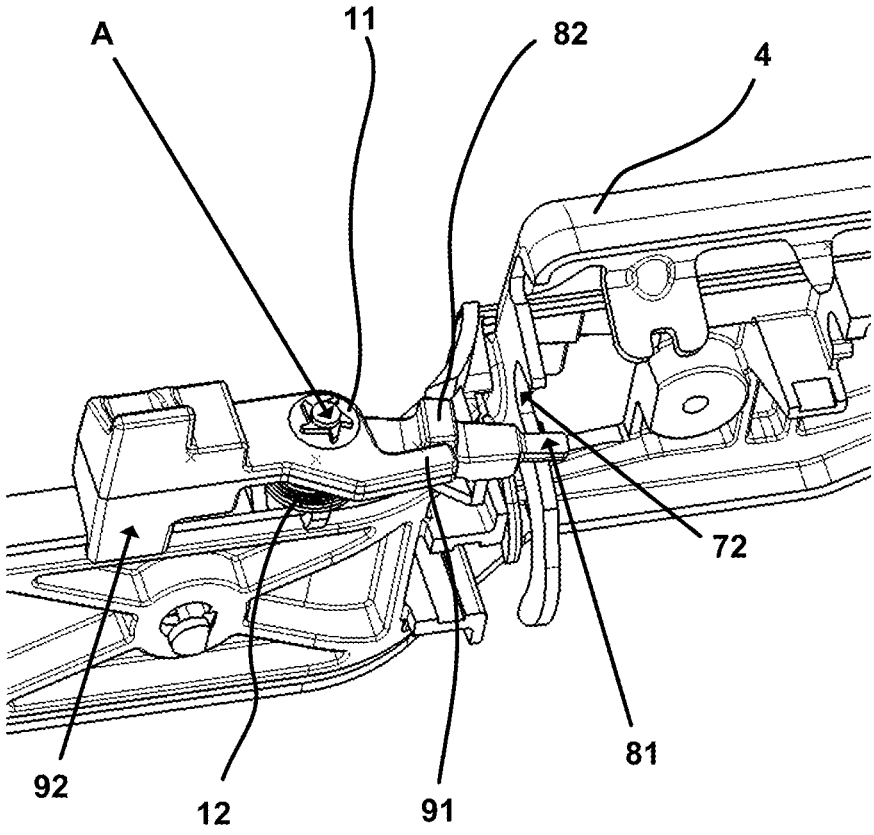
FIG. 4 is a perspective view of the first and second levers in an unlocked position in accordance with an exemplary embodiment of the invention.

With reference to FIG. 4, when the vehicle is not involved in a collision, the locking mechanism is in the unlocked position, i.e., the levers 8 and 9 are in their neutral equilibrium position and the bolt member 81 does not restrict the movement of the counterweight 4 around the axis of rotation 40. This is to say that in the unlocked position, the movement of the counterweight 4 in the counterclockwise direction unlatches an unlocked door release mechanism. In the unlocked position, the finger 91 of the lever 8 rests against the protrusion 82.

Figure 5:
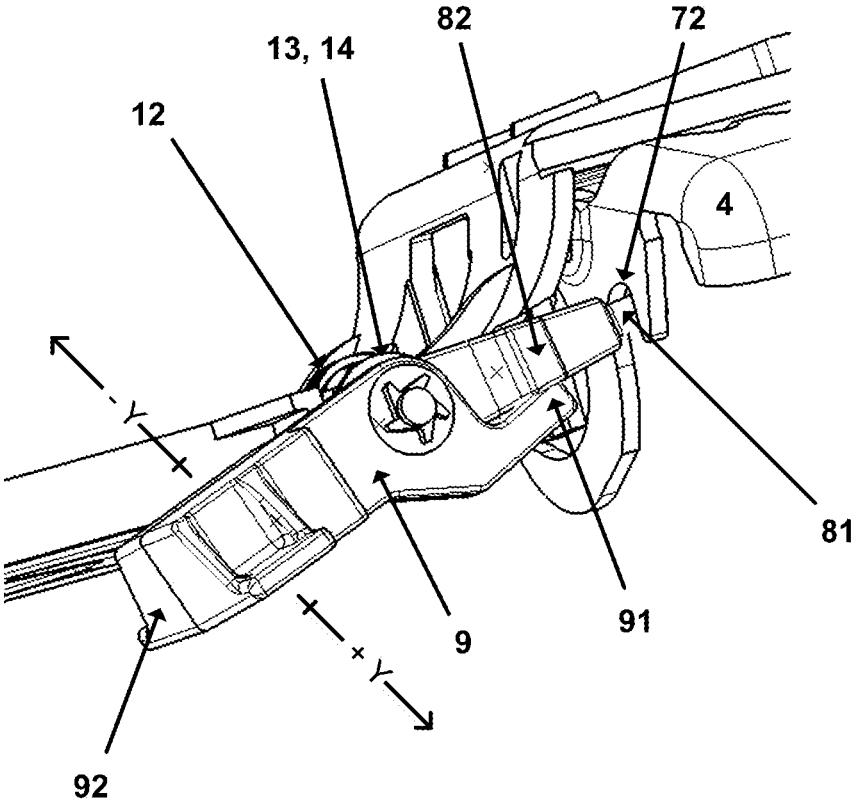
FIG. 5 is a perspective view of the first and second levers in a locked position in accordance with an exemplary embodiment of the invention.

With reference to FIG. 5, when the vehicle is involved in a collision, initially the locking mechanism may experience a positive Y-acceleration, which will cause the weight member 92 to rotate counterclockwise around the axis of rotation A. The weight member 92 will only rotate counterclockwise around the axis of rotation A if the inertial force it experiences is larger than the sum of the stretching forces exerted by the spring 12 and the inertial force acting on the lever 8. The lever 9 will then urge the lever 8 to rotate counterclockwise in concert with the lever 8 by the finger 91 pressing against the protrusion 82. The mass of the weight member 92 must be higher than that of the finger 91 and the lever 8 to more than counteract the inertial forces acting on the finger 91 and the lever 8.

The spring constant of the spring 12 is set so that inertial forces normally experienced during a vehicle collision will turn the lever 9 and with it the lever 8 until the bolt member 81 engages into the first U-shaped opening 72, and the locking mechanism assumes a locked position. When the bolt member 81 engages into the first U-shaped opening 72, the counterweight 4 is blocked from being rotated in the counterclockwise direction, and will not unlatch the door release mechanism.

During a later part of the collision, the locking mechanism may experience a negative Y-acceleration, which will cause the weight member 92 to rotate clockwise around the axis of rotation A back towards its equilibrium position. At this time, the lever 9 will disengage with lever 8 and will no longer urge it to rotate counterclockwise. The lever 8 will, however, remain in the locked position because the inertial forces acting upon it will now urge it to rotate counterclockwise. When the inertial forces due to a collision subside, the lever 8 will return to its equilibrium positions as shown in FIG. 4 by the action of the spring 12.

By utilizing the locking mechanism according to the invention, disengagement of the door handle is achieved at a much earlier stage during a collision as compared with conventional safety mechanisms. In addition, the mechanism remains engaged even when the acceleration changes from negative to positive, only to reengage the door handles after the collision forces have fully subsided.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and the following claims.

All publications and patent applications mentioned in this specification are indicative of the level of skill of those skilled in the art to which this invention pertains. All publications and patent applications mentioned in this specification are herein incorporated by reference to the same extent as if each individual publication or patent application mentioned in this specification was specifically and individually indicated to be incorporated by reference.

What is claimed is:

1. A mechanism for a vehicle door handle assembly activated by an inertial force acting on the mechanism to prevent a vehicle door from opening during a vehicle collision, the mechanism comprising:

a first lever having an axis of rotation; and a second lever;

wherein said first lever is engageable with the door handle assembly;

said second lever comprises a weight member and a finger member;

said finger member is engageable with said first lever;

said second lever is rotatable around said axis of rotation in response to the inertial force; and said first lever engages with the door handle assembly and blocks the door handle assembly from being rotated only when the inertial force is applied thereby to prevent the vehicle door from opening during the vehicle collision, and does not engage with the door handle assembly when the inertial force is not applied;

the mechanism further comprising means for providing resistance to rotation of said first lever and said second lever, wherein when the inertial force is applied to the mechanism in a first direction, said first lever and said second lever rotate in concert whereby said first lever engages with the door handle assembly, and when the inertial force is applied to the mechanism in a second direction, said second lever rotates back to its original position and said first member continues to be engaged with the door handle assembly.

2. A mechanism for a vehicle door handle assembly activated by an inertial force acting on the mechanism to prevent a vehicle door from opening during a vehicle collision, the mechanism comprising:

a first lever having an axis of rotation; and a second lever;

wherein said first lever is engageable with the door handle assembly;

said second lever comprises a weight member and a finger member;

said finger member is engageable with said first lever;

said second lever is rotatable around said axis of rotation in response to the inertial force; and when an inertial force is applied to the mechanism in a first direction, said finger member pushes said first lever to rotate and to enter into an opening in the vehicle door handle assembly whereby blocking the vehicle door handle assembly from being opened, and when an inertial force is subsequently applied to the mechanism in a second direction, said finger member rotates back to its original position and said first member continues to block the vehicle door handle assembly from being opened thereby to prevent the vehicle door from opening during the vehicle collision until the inertial force subsides.

3. The mechanism of claim 1, wherein said first lever and said second lever are spring-loaded.

4. The mechanism of claim 1, wherein when the inertial force is greater than a force exerted by said means for providing resistance to rotation, said first lever engages with the door handle assembly.

5. The mechanism of claim 1, wherein said first lever further comprises a protrusion, said finger member being engageable with said protrusion.

6. The mechanism of claim 1, wherein said means for providing resistance to rotation is one or more helical springs.

7. The mechanism of claim 1, wherein said first lever and said second lever are rotatably fixed around said axis of rotation each by a separate pivot bearing.

8. The mechanism of claim 1, wherein said mechanism is attached to said vehicle door handle assembly.

9. The mechanism of claim 1, wherein the mass of said weight member is greater than the mass of said finger member, and the mass of said weight member is greater than the mass of said first lever.

10. The mechanism of claim 2, wherein said first lever and said second lever are spring-loaded.

11. The mechanism of claim 2, further comprising means for providing resistance to rotation of said first lever and said second lever.

12. The mechanism of claim 11, wherein when the inertial force is greater than a force exerted by said means for providing resistance to rotation, said first lever engages with the door handle assembly.

13. The mechanism of claim 2, wherein said first lever further comprises a protrusion, said finger member being engageable with said protrusion.

14. The mechanism of claim 11, wherein said means for providing resistance to rotation is one or more helical springs.

15. The mechanism of claim 2, wherein said first lever and said second lever are rotatably fixed around said axis of rotation each by a separate pivot bearing.

16. The mechanism of claim 2, wherein said mechanism is attached to said vehicle door handle assembly.

17. The mechanism of claim 2, wherein the mass of said weight member is greater than the mass of said finger member, and the mass of said weight member is greater than the mass of said first lever.

* * * * *